US006612531B2

(12) United States Patent
Wu

(10) Patent No.: US 6,612,531 B2
(45) Date of Patent: Sep. 2, 2003

(54) STRUCTURE TWO-LEVEL SUSPENDED LAMP FRAME

(76) Inventor: Wen-Chang Wu, No.10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/915,268

(22) Filed: Jul. 27, 2001

(65) Prior Publication Data

US 2003/0019994 A1 Jan. 30, 2003

(51) Int. Cl.[7] ..... A47H 1/10; F21S 8/06

(52) U.S. Cl. ..... 248/317; 248/343; 362/405; 362/406

(58) Field of Search ..... 248/317, 342, 248/343, 344, 213.2, 224.8, 229.26; 362/404, 405, 406

(56) References Cited

U.S. PATENT DOCUMENTS 285,310 A * 9/1883 Shaffer ..... 362/388
905,089 A * 11/1908 McBerty ..... 310/68 A
1,575,168 A * 3/1926 Kestell ..... 248/344
1,668,772 A * 5/1928 Kestell ..... 362/405
3,735,123 A * 5/1973 Porter et al. ..... 362/406
4,107,770 A * 8/1978 Weber ..... 362/405

* cited by examiner

*Primary Examiner*—Anita King
(74) *Attorney, Agent, or Firm*—Troxell Law Office PLLC

(57) ABSTRACT

An improved two-level suspended lamp frame including a mount fastened onto a ceiling, a junction box extending below the mount, and a pendant fixture inserted at the sides of the mount and the junction box. The mount has insertion holes in which a coupling spring having two inward closured retentive ends is disposed at the interior face of each insertion hole. The junction box has openings formed in its circumference for the fitting of mounting blocks and retaining elements are installed at the two sides of each mounting block. Each pair of retaining elements has secured to their hook nibs an elastic component which, under normal conditions, pulls the inward protruding ends towards the inside of sleeved holes. As such, the rectangular insertion pegs of the pendant fixture are aligned with and slipped into the insertion holes of the junction box and tightly anchored without requiring additional fastening screws and tools to thereby effectively facilitate ease of assembly and installation.

5 Claims, 5 Drawing Sheets

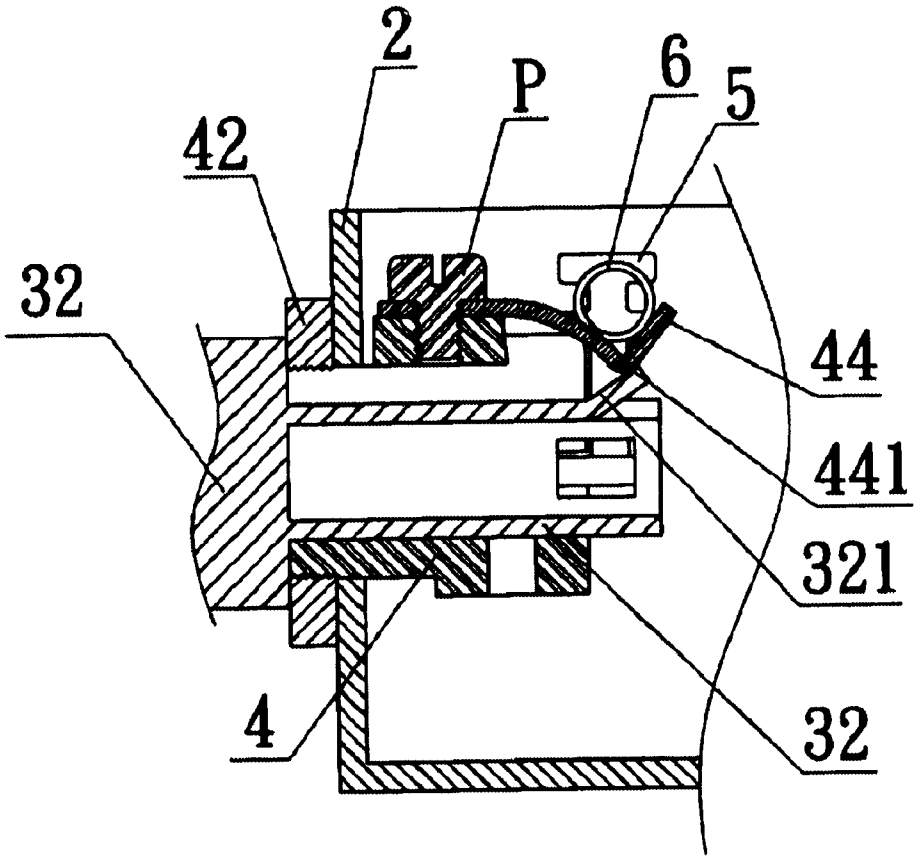
FIG. 1-A

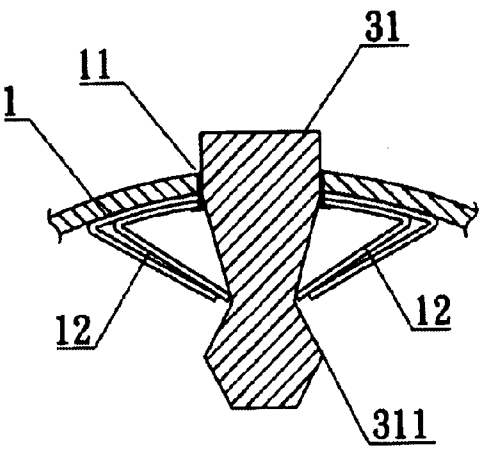
FIG. 2-C
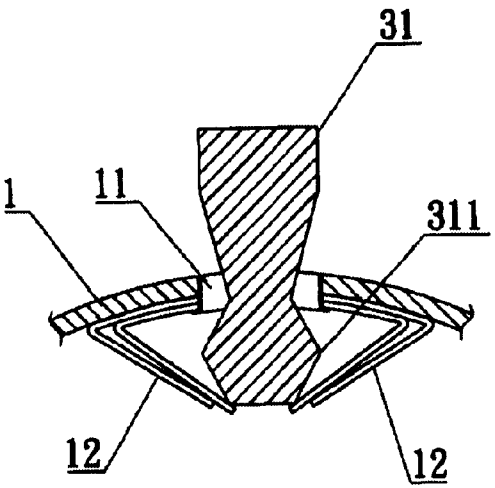
FIG. 2-B
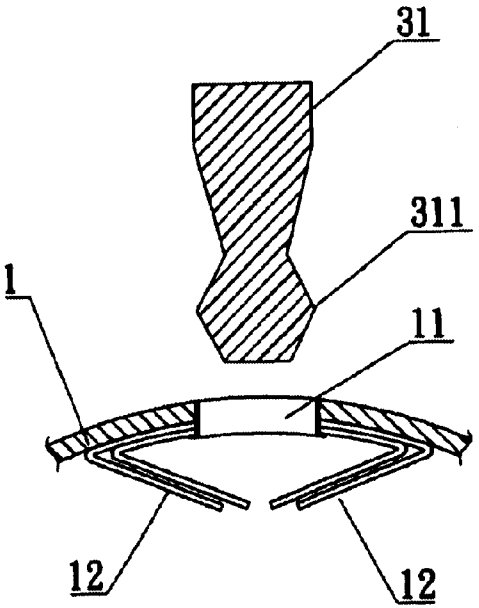
FIG. 2-A

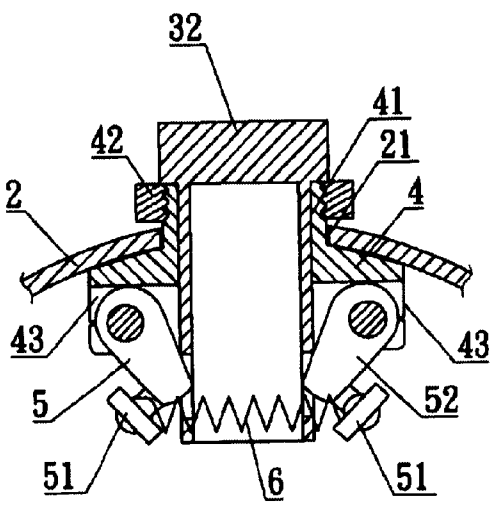
FIG. 3-C
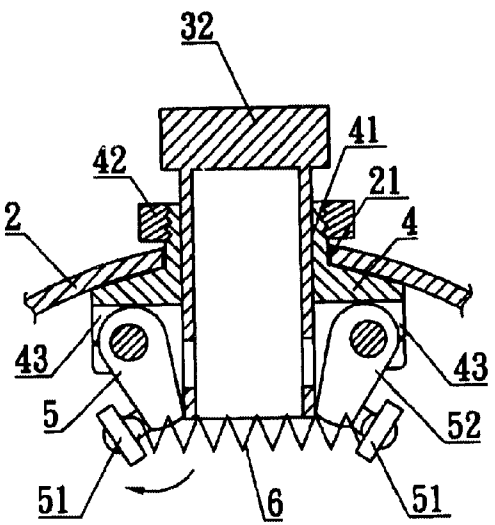
FIG. 3-B
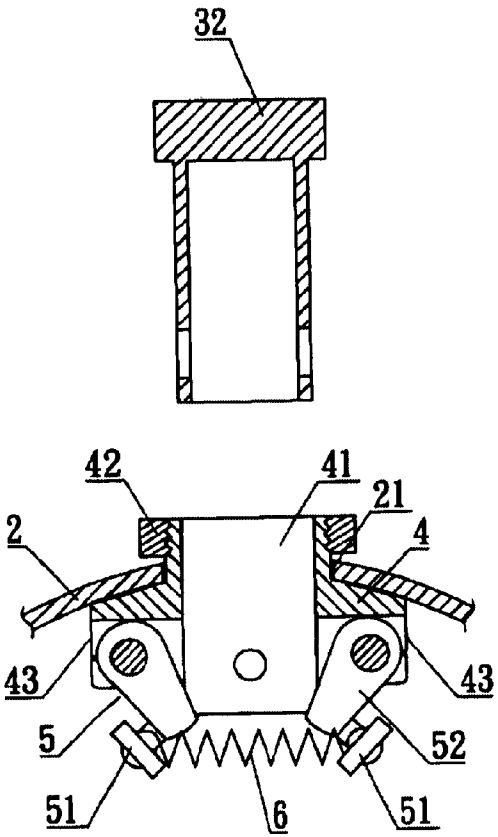
FIG. 3-A

STRUCTURE TWO-LEVEL SUSPENDED LAMP FRAME

BACKGROUND OF THE INVENTION

1. Field of the Invention

The invention herein relates to an improved two-level suspended lamp frame, wherein the mount has insertion holes in which a coupling spring having two inward closured retentive ends is disposed at the interior face of each insertion hole; the junction box has openings formed in its circumference for the fitting of mounting blocks and a pair of retaining elements are installed at the two sides of each mounting block; each pair of retaining elements has secured to their hook nibs an elastic component which under normal conditions pulls the inward protruding ends towards the inside of sleeved holes; as such, the rectangular insertion pegs of the pendant fixture are aligned with and slipped into the insertion holes of the junction box and tightly anchored without requiring additional fastening screws and tools to thereby effectively facilitate ease of assembly and installation.

2. Description of the Prior Art

The assembly and installation of conventional lighting frame structures for wall lamps, table lamps, and floor lamps typically require fastening by means of screws and nuts; however, the use of such fasteners for assembly and installation not only risks damage to finished products, but also requires tools (such as wrenches and screwdrivers, etc.) that often are the cause of assembly and installation difficulties; in view of the said drawbacks, the inventor of the invention herein conducted research that culminated in the successful development of the present invention.

SUMMARY OF THE INVENTION

The primary objective of the invention herein is to provide an improved two-level suspended lamp frame comprised of a mount, a junction box, and a pendant fixture, wherein the mount has insertion holes in which a coupling spring having two inward closured retentive ends is disposed at the interior face of each insertion hole; the junction box has openings formed in its circumference for the fitting of mounting blocks and a pair of retaining elements are installed at two sides of each mounting block; each pair of retaining elements has secured to their hook nibs an elastic component which under normal conditions pulls the inward protruding ends towards the inside of sleeved holes, thereby providing for the alignment and entrance of the rectangular insertion pegs of the pendant fixture into the insertion holes of the junction box to achieve tight anchoring without requiring additional fastening screws and tools to effectively facilitate ease of assembly and installation.

BRIEF DESCRIPTION OF THE DRAWINGS

FIG. 1-A is a cross-sectional drawing as viewed from the perspective of line I—I in FIG. 1.

FIG. 2-A is a cross-sectional drawing of the upper insertion peg under normal conditions.

FIG. 2-B is a cross-sectional drawing of the upper insertion peg during entry.

FIG. 2-C is a cross-sectional drawing of the upper insertion peg after entry.

FIG. 3-A is a cross-sectional drawing of the lower insertion peg under normal conditions.

FIG. 3-B is a cross-sectional drawing of the lower insertion peg during entry.

FIG. 3-C is a cross-sectional drawing of the lower insertion peg after entry.

DETAILED DESCRIPTION OF THE INVENTION

Figure 1:
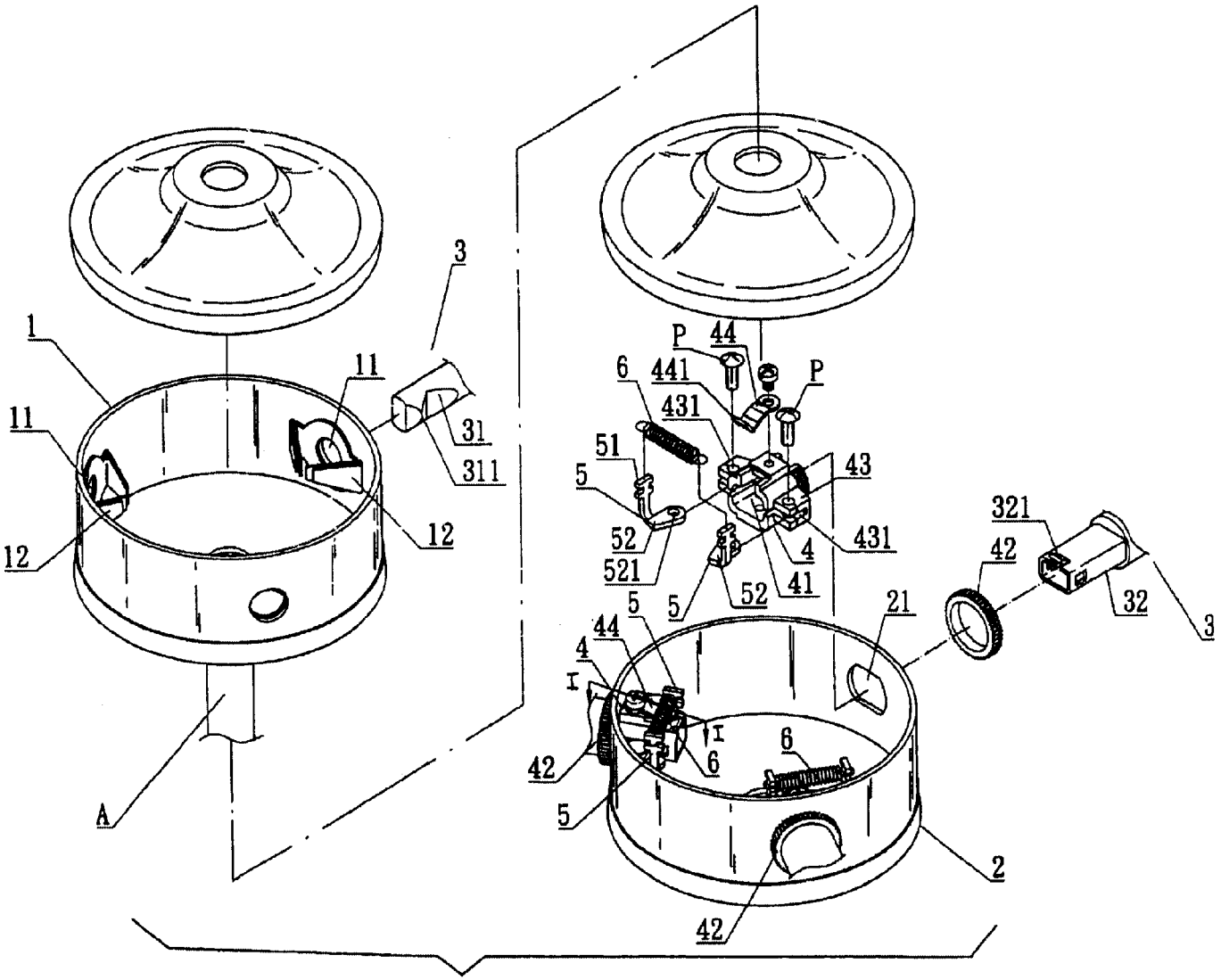
FIG. 1 is an exploded drawing of the invention herein.

Referring to FIGS. 1–4, the structural arrangement of the present invention, the invention herein is comprised of a mount 1 fastened to a ceiling, a support rod A extending to a junction box 2 below the mount 1, and a pendant fixture 3 inserted at the sides of the mount 1 and the junction box 2, of which:

The mount 1 has insertion holes 11 formed in the side that provide for the entry of the pendant fixture 3 upper insertion pegs 31. A coupling spring 12 having two inward closured retentive ends is disposed at the interior face of each insertion hole 11 such that after the entrance of each upper insertion peg 31, the coupling spring 12 is pushed an appropriate degree until it clips onto the upper insertion peg 31. The junction box 2 has situated within it mounting blocks 4 and retaining elements 5 with a tensile part 44 fastened onto each mounting block 4. The junction box 2 has openings 21 formed in its circumference and a mounting block 4 is fitted into each opening 21 such that the rectangular sleeved hole 41 at the lateral ends of the said mounting blocks 4 project through the openings 21 and each is fastened by a mounting ring 42 against the outer circumference of the junction box 2 at the positions where the sleeved holes 41 pass through junction box 2 to thereby secure the mounting blocks 4 inside the junction box 2.

Clevis tabs 43 having through-holes are formed along two sides of each mounting block 4 inside the junction box 2. The upper and lower portions of the said clevis tabs 43 are symmetrical in profile and a space 431 is left between them to provide for the insertion of retaining elements 5. The tensile parts 44 are fastened onto the top ends of the mounting blocks 4 with the front extremity of each tensile part 44 bent upward slightly to form a lower insertion peg 32 engagement end 441.

Each retaining element 5 is an L-shaped structure installed in pairs with hook nibs 51 fabricated in the vertical surface and a through-hole 521 formed in the horizontal insert surface 52. The insert surface 52 of the retaining element is placed into the space 431 of the mounting block 4 and a pin P is inserted into the through-holes of the clevis tabs 43 and the through-hole 521 of each retaining element 5 to maintain the position of the retaining elements 5 on the mounting block 4. An elastic component 6 is secured to the hook nibs 51 of each pair of retaining elements 5 and under normal conditions, the elastic component 6 pulls the inward protruding hook nibs 51 towards the inside of the sleeved holes 41.

The pendant fixture 3 is positioned in alignment with the mount 1 openings 21 and has rectangular upper insertion pegs 31 with tips of the upper insertion pegs 31 profiled with snap-fit ball ends 311 such that after each upper insertion peg 31 is inserted into the mount 1, the upper insertion peg 31 pushes against the coupling spring 12 an appropriate degree, whereby the coupling spring 12 clips onto the insertion peg 13 to thereby maintain the position of the upper insertion peg 31 in the mount 1 (as shown in FIG. 2-A, FIG. 2-B, and FIG. 2-C).

The pendant fixture 3 is also positioned in alignment with the mounting block 4 sleeved holes 41 and has rectangular lower insertion pegs 32 with the tips of the lower insertion pegs 32 profiled with snap-fit ends 321 such that after each lower insertion peg 32 is inserted into the junction box 2, the snap-fit end 321 is arrested by the engagement end 441 of the tensile part 44 to firmly anchor the pendant fixture 3 onto the junction box 2 (as shown in FIG. 1-A).

As for the operating method, referring to FIG. 3, the retaining elements 5 of the junction box 2 under normal conditions project slightly towards the inside of the sleeved holes 41, with the elastic component 6 clinched onto the top ends of the retaining elements 5 in a compressed state (as shown in FIG. 3-A).

When the lower insertion pegs 32 of the pendant fixture 3 are inserted into the sleeved holes 41, the lower insertion pegs 32 push apart the retaining elements 5 an appropriate degree and pull the elastic component 6 at the top end of the retaining elements 5, thereby providing for the entry of the lower insertion pegs 32 into the sleeved holes 41 of the mounting blocks (as shown in FIG. 3-B).

Following the entry of the lower insertion pegs 32, the snap-fit ball ends 321 pass the elastic component 6 and the retaining elements 5, causing the return of the elastic component 6 to its original position and the retaining elements 5 to clip inward onto the lower insertion pegs 32 such that the snap-fit end 321 is secured by the retaining elements 5 to prevent their rearward extraction to thereby firmly anchor the pendant fixture 3 in position on the junction box 2 (as shown in FIG. 3-C).

Figure 4:
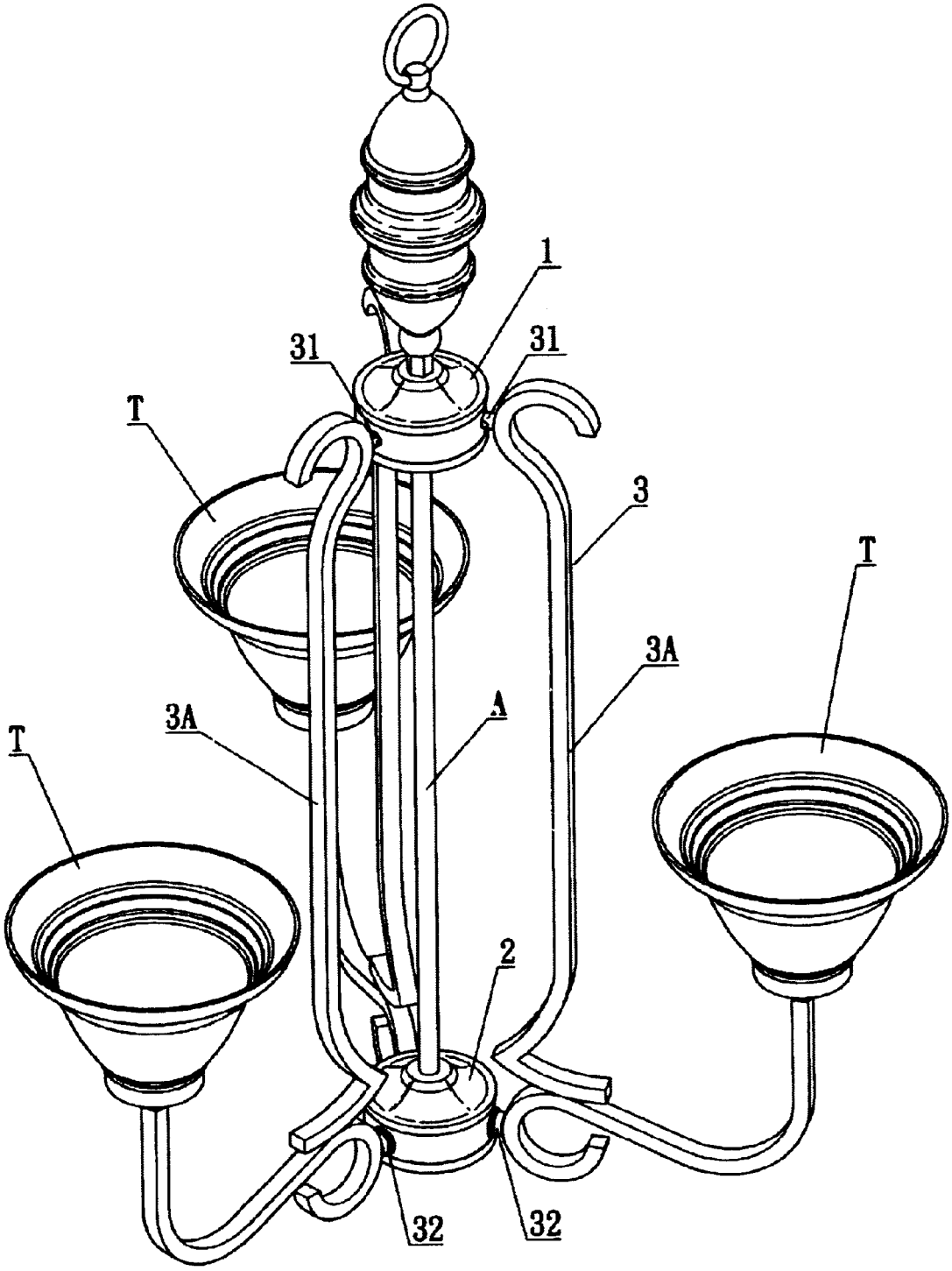
FIG. 4 is an isometric drawing of an embodiment of invention herein utilized in a light fixture application.

Referring to FIG. 4, the drawing of an embodiment of invention herein as utilized in a light fixture application, the pendant fixture 3 consists of three identical frame members 3A with the top ends of the frame members 3A inserted into the mount 1 and the bottom ends of the frame members 3A elevated outward to provide for the placement of light bulb sockets on the raised extremities T of the frame members 3A, which thereby becomes an attractive and stylish two-level suspended lamp frame.

What is claimed is:

1. An improved two-level suspended lamp frame comprising: a mount adapted to be fastened onto a ceiling, a junction box extending below the mount, and a pendant fixture inserted at sides of the mount and the junction box, wherein:

the mount has insertion holes formed in the sides that provide for entry of pendant fixture upper insertion pegs; a coupling spring having two inward closured retentive ends disposed at an interior face of each insertion hole, with the coupling springs configured to clip onto the upper insertion pegs;

the junction box has openings in which mounting blocks are fitted, the mounting blocks having a pair of retaining elements; a tensile part; a sleeved hole formed in each mounting block; clevis tabs formed along two sides said mounting block whereby said retaining elements are installed on the clevis tabs; the tensile parts are fastened onto tops of the mounting blocks with a front extremity of each said tensile part bent upward to form a lower insertion peg engagement end; each retaining element has hook nibs and a horizontal insert surface that is hinged onto the mounting blocks, with an elastic component secured to the hook nibs of each pair of retaining elements, such that, under normal conditions, the elastic component pulls the hook nibs towards an inside of the sleeved holes; the pendant fixture is positioned in alignment with the mount openings and has upper insertion pegs, each upper insertion peg being inserted into the mount, such that the coupling spring clips onto the upper insertion peg; and the pendant fixture is also positioned in alignment with the mounting block's sleeved holes and has rectangular lower insertion pegs, each peg inserted into the junction box, and is arrested by the engagement end of said tensile part.

2. The improved two-level suspended lamp frame of claim 1 wherein the mounting blocks fitted into the junction box's openings are each fastened by a mounting ring against an outer circumference of the junction box at positions where the sleeved holes pass through the junction box.

3. The improved two-level suspended lamp frame of claim 1 wherein the clevis tabs have upper and lower spaced apart portions that are symmetrical in profile and each retaining element is an L-shaped structure with said horizontal insert surface placed into a space formed between said upper and lower portions of the mounting block; and a pin inserted through the clevis tabs and the retaining element to attach the retaining elements to the mounting blocks.

4. The improved two-level suspended lamp frame of claim 1 wherein the lower insertion pegs have tips forming snap-fit ends and wherein each snap-fit end is arrested by the engagement end of the said tensile part.

5. The improved two-level suspended lamp frame of claim 1 wherein the junction box openings have a polygonal shape.

* * * * *